US005921799A

United States Patent [19]

Forrester

[11] Patent Number: 5,921,799

[45] Date of Patent: Jul. 13, 1999

[54] ELECTRICAL RECEPTACLE WITH RELEASABLE LOCKING MECHANISM

[76] Inventor: David Forrester, 8th floor, 550-6th Ave., Calgary, Canada, T2p 0s2

[21] Appl. No.: 08/911,414

[22] Filed: Aug. 14, 1997

[51] Int. Cl.[6] ..... H01R 4/50

[52] U.S. Cl. ..... 439/346

[58] Field of Search ..... 439/346, 347, 439/348, 369, 352, 320, 321, 372

[56] References Cited

U.S. PATENT DOCUMENTS

| | | | |
|---|---|---|---|
| 2,704,831 | 5/1955 | Smith . | |
| 3,543,218 | 11/1970 | Archer . | |
| 4,085,991 | 4/1978 | Marshall . | |
| 4,136,919 | 1/1979 | Howard . | |
| 4,319,797 | 3/1982 | Otani . | |
| 4,932,886 | 6/1990 | Glaser | 439/137 |
| 5,281,162 | 1/1994 | Ursich | 439/346 |
| 5,286,213 | 2/1994 | Altergott et al. | 439/139 |
| 5,413,498 | 5/1995 | Ursich | 439/346 |

*Primary Examiner*—Khiem Nguyen
*Attorney, Agent, or Firm*—David S. Thompson

[57] ABSTRACT

An electrical receptacle with a releasable locking mechanism is disclosed. A body formed from upper and lower body portions encloses line and neutral contact assemblies and a ground contact assembly. The line and neutral contact assemblies carry a latching mechanism which releasably and automatically engages the holes in the line and neutral prongs of a standard electrical plug. A collar, carried by the body slides between a forward position and a rearward position. The collar is biased to the forward position. Moving the collar rearwardly pivots the latching mechanism, thereby releasing the prongs of the plug. Moving the collar rearwardly and rotating it to the right causes a release hold structure in the collar to engage the latching mechanism, keeping it in the unlocked position. Moving the collar rearwardly and rotating it to the left causes a release disable structure in the collar to engage the latching mechanism, keeping it in the locked position.

5 Claims, 14 Drawing Sheets

FIG. 6
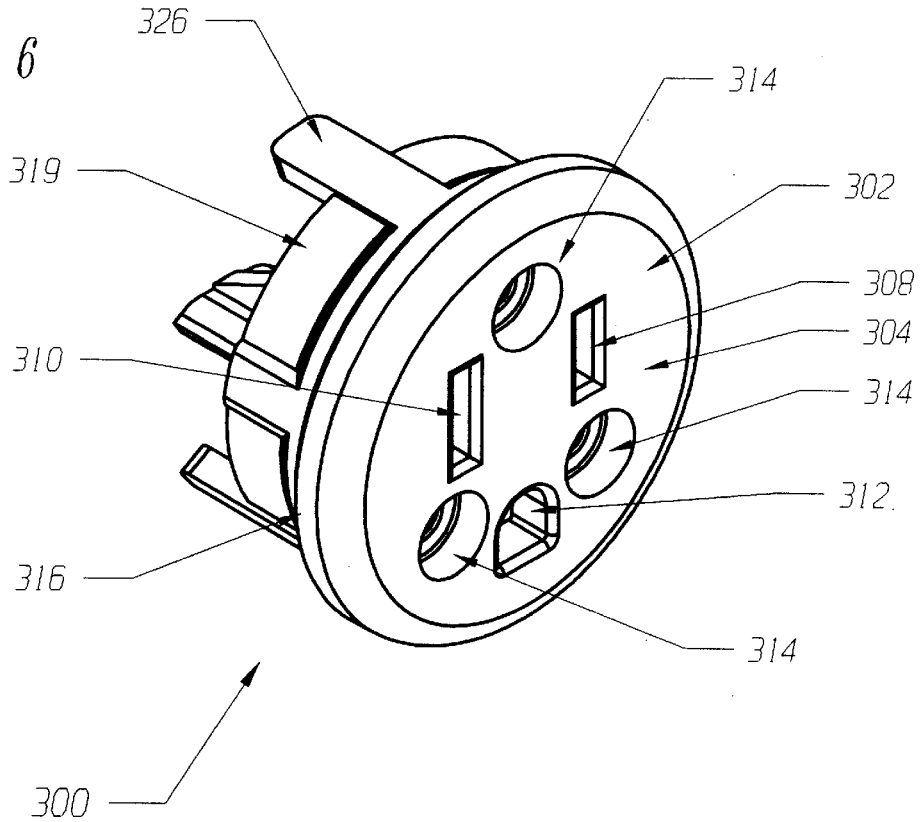
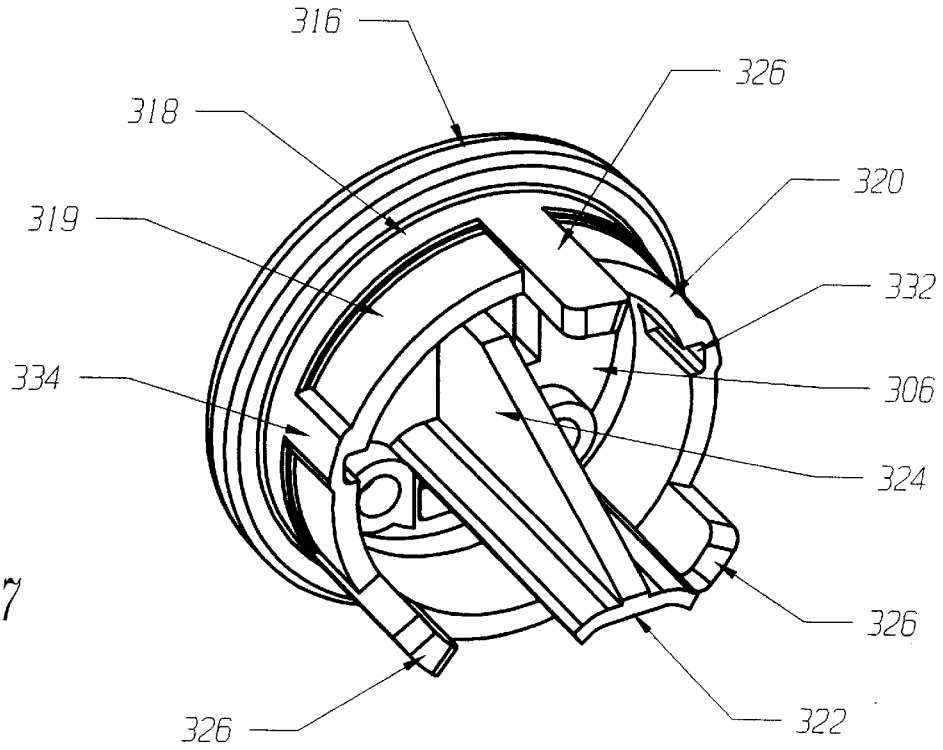
FIG. 7

ELECTRICAL RECEPTACLE WITH RELEASABLE LOCKING MECHANISM

CROSS-REFERENCES

There are no applications related to this application filed in this country or any foreign country.

BACKGROUND

A multitude of female electrical plug receptacles intended for use with 110–125 VAC North American type electrical plugs have been introduced to make an electrical connection with the standard two-pronged or grounded male electrical plug. Particularly where an extension cord is in use, there is a persistent problem in that the plug may inadvertently become disconnected from the receptacle. Such inadvertent disconnection may at best be the cause of decreased productivity, frustration and annoyance, but also can be dangerous, where an unexpected loss of essential power may be the source of potential trouble and perhaps even cause an accident.

The vast majority of male plugs typically include a small ⅛' diameter hole near the end of each prong, usually within a standard range of distance from the plug face. The prior art includes a variety of examples of how these holes may be engaged to prevent inadvertent release. In U.S. Pat. No. 5,286,213 to Altergott et al., small rounded nubs engage the holes in the male prongs. In U.S. Pat. No. 4,319,797 to Otani et al., an electrical connector provides an arm having a hook portion which engages a prong having holes. And, in U.S. Pat. No. 4,932,886 to Glaser, articulated arm assemblies engage the holes of the male prongs.

In spite of these advances, known locking receptacles have not solved the all of the problems of inadvertent disconnection. While some progress has been made at making a secure connection, the prior art has not generally provided structures that will accomplish this task automatically, with safety and economy. As a result, the user is required to twist, press, or in some other manner activate and deactivate the locking mechanism. As a result, such locking structures are not entirely successful at preventing inadvertent disconnection.

Another problem generally seen in the prior art is that some structures employed require a male prong of specific size, shape or design to be compatible. Further, the standard male prongs must be properly aligned for the locking mechanism to function. Some locking mechanisms are poorly adapted to two-prong polarized plugs. Other designs are unforgiving when used with somewhat bent prongs, polarized prongs or excessively worn prongs, and often fail to lock properly.

Another problem seen in the prior art is that the elements forming the locking mechanism are specifically designed for that mechanism only and are not compatible with the standard plug. The twist lock type plugs are typical examples.

Another problem generally seen in the prior art is that the exterior designs do not have a smooth and streamlined body shape that allows the receptacle to flow smoothly along the ground as it is being dragged about. The poor shape design, with its sharp and abrupt edges and corners, allows the body to be caught up in, and snagged by, debris and obstacles, thereby putting unusual strain upon the attached cords and connections inside of both the receptacle and the plug. The resultant stress may lead to frayed insulation, short circuits, loosened terminal connections and other hazards.

Another problem seen in the prior art is that the wiring is inadequately attached to the receptacle. As a result, under repeated strain or momentary shock the wire may come loose from the connector.

A still further problem seen in the prior art is that receptacles fail to provide a cord strain reducing structure that prevents excessive bending and fraying by the cord adjacent to the receptacle. Such a strain reducing structure should be able to accommodate various diameters of commercially available cords.

SUMMARY

The present invention is directed to an apparatus that satisfies the above needs. A novel electrical receptacle, suitable for use with a male electrical plug of any standard type, provides some or all of the following structures.

(A) A body, formed from an upper body portion and a lower body portion, wherein the upper body portion may include:

(a) A sidewall, defining a forward cavity, a rear cavity, at least one spring well, slots for springs extending from spring wells in the bottom body portion and a wiring cover interlock.

(b) At least one forward snap pin, carried by the sidewall.

(c) At least one screw boss, carried by the sidewall, for attachment to the cap.

(d) A contact isolator, carried by the sidewall, separating left and right cavities within the body.

(e) A collar guide, defined by the sidewall, including a dirt recess and a dirt dam, adjacent to the dirt recess.

(f) At least one guide pin, carried by the collar guide.

(g) Two contact mounting slots.

(h) A terminal support surface, carried by the sidewall, which supports the terminal portion of the line and neutral contact assemblies.

(i) A rear anchor pin, carried by the sidewall, for releasably engaging the rear anchor pin mount of the bottom body portion.

(j) A spring, carried by each of the spring wells and extending through slots in the bottom body portion, for biasing the collar forwardly, toward the cap.

(B) A lower body portion, which may include:

(a) A sidewall, defining at least one forward snap pin socket, at least one spring well, a line contact mounting slot, a neutral contact mounting slot, a ground contact mounting slot, a ground well, at least one guide pin socket sized to engage a guide pin carried by the collar guide of the upper body portion, slots for springs extending from the spring wells of the upper body portion and a wiring cover interlock.

(b) At least one screw boss, carried by the sidewall, for use in fastening the lower body portion to the cap, typically with elongate screws.

(c) A collar guide, defined by the sidewall, including a dirt recess and a dirt dam, adjacent to the dirt recess.

(d) A terminal support surface.

(e) A rear anchor pin mount, sized to releasably engage the rear anchor pin of the top body portion.

(f) A spring, carried by each of the spring wells and extending through slots in the top body portion, for biasing the collar forwardly, toward the cap.

(C) A cap, which may include:

(a) A face defining a line prong hole, a neutral prong hole, a ground prong hole and at least two fastening screw holes. One screw hole is associated with, and aligned with, each screw boss provided by the top or bottom body portions, thereby allowing the cap to be attached to the upper and lower body portions.

(b) A cylindrical body defining a perimeter rim having an annular shoulder.

(c) A ground isolator, extending rearwardly from the face, electrically isolates the ground contact assembly and the ground prong of the standard male plug from the line and neutral contact assemblies.

(d) A contact isolator, extending rearwardly from the face, tends to electrically isolate the line and neutral contact assemblies from each other.

(e) At least two collar guides, carried by the cylindrical body, align the cap with the body.

(D) Line contact and neutral contact assemblies, carried within the body, may each include:

(a) A prong enclosure, defining first and second latching mechanism pivot slots; the prong enclosure carrying opposed left and right prong contacts and carrying opposed upper and lower prong contacts.

(b) A planar body, extending from the prong enclosure, defining a latching mechanism spring board.

(c) Upper and lower contact mounting tabs, carried by the planar body, for engaging the line or neutral mounting slot in the upper and lower body portions.

(d) A contact terminal, carried by the planar body, defining at least one barb and a clamp slot.

(e) A non-rotating wire clamp having a support arm carried by the clamp slot, the non-rotating wire clamp defining at least one barb.

(f) A wire guide flange, carried by the planar body, defining a wire guide slot and a soldering slot about which the end of a wire may be inserted and soldered, if desired.

(g) A latching mechanism, comprising a body defining a keel sized to extend into the first and second latching mechanism pivot slots, a barb sized to extend into a hole in a prong of the standard male plug, a release disable tab and a release button.

(E) A ground contact assembly, may include:

(a) A contact support, carrying left and right contacts, the contacts sized for making electrical contact with a ground prong of the standard male plug.

(b) An elongate body, connected to the contact support, having an alignment notch sized for insertion into the ground contact mounting slot in the lower body portion.

(c) A contact terminal plate defining a threaded fastening hole and at least one barb and a clamp slot, the contact terminal plate connected to the elongate body.

(d) A non-rotating wire clamp having at least one barb, the non-rotating wire clamp having a support arm carried by the clamp slot.

(F) A collar, slidably carried about the upper and lower body portions between a forward position and a rearward position, the collar comprising a cylindrical body defining:

(a) A release structure for engaging the release button of the latching mechanism when the collar is in the rearward position, thereby causing the barb of the latching mechanism to release the prong of the standard male plug.

(b) A release disable structure for preventing the barb from releasing the prong of the standard male plug.

(c) A release hold structure for preventing the barb of the latching mechanism from engaging the prong of the standard male plug.

(G) A spring, having a coiled middle portion and first and second ends; wherein a first end is locked securely within one of the spring wells defined by the body and a second end extends out of the body and into contact with a spring engagement rim defined by the collar, thereby biasing the collar forwardly.

(H) A wiring cover formed from a top wiring cover portion and a bottom wiring cover portion, fastened together. Each wiring cover portion may include:

(a) A tapered body defining an interior cavity having open forward and rearward ends.

(b) A forward interlock, defined in the forward end of the tapered body, is sized to engage the wiring cover interlock of the top body portion and bottom body portion.

(d) A rearward interlock, defined in the rearward end of the tapered body.

(I) A cord protector, comprising an elongate body defining an interior cavity, the elongate body having a forward opening framed by a forward interlock sized to engage the rearward interlock of the wiring cover.

It is therefore a primary advantage of the present invention to provide a novel electrical receptacle with a releasable locking mechanism that automatically locks into the holes in the line and neutral prongs of a standard electrical plug immediately after the plug is inserted into the receptacle.

Another advantage of the present invention is to provide a novel electrical receptacle with a releasable locking mechanism that will not accidentally release, and that is easily made to release the standard electrical plug by sliding back a collar against a spring bias.

Another advantage of the present invention is to provide a novel electrical receptacle with a releasable locking mechanism having a collar that may be rotated, thereby engaging release disable means, preventing release of an electrical plug until the collar has been counter-rotated.

Another advantage of the present invention is to provide a novel electrical receptacle with a releasable locking mechanism having a collar that may be rotated, thereby engaging release hold means, preventing the locking of an electrical plug until the collar has been counter-rotated.

Another advantage of the present invention is to provide a novel electrical receptacle with a releasable locking mechanism that contains a collar spring system having spring stops defined in the spring engagement rim of the collar that precisely align and bias the collar forwardly, and keeps the collar from rotating freely once it has been pulled back.

Another advantage of the present invention is to provide a novel electrical receptacle with a releasable locking mechanism that indicates that the lock is activated with a distinct tactile snap and associated click.

A still further advantage of the present invention is to provide a novel electrical receptacle with a releasable locking mechanism that is attached to an incoming electrical wire by means of non-rotating wire clamps carried by contact plates, wherein both the wire clamps and contact plates provide barbs which engage the wire, thereby preventing accidental release even if the wire is jerked with substantial force.

DRAWINGS

These and other features, aspects, and advantages of the present invention will become better understood with regard to the following description, appended claims, and accompanying drawings where:

FIG. 6 is a perspective view of the cap, showing the face;

FIG. 7 is a perspective view of the cap, showing the backside;

DESCRIPTION

Figure 1:
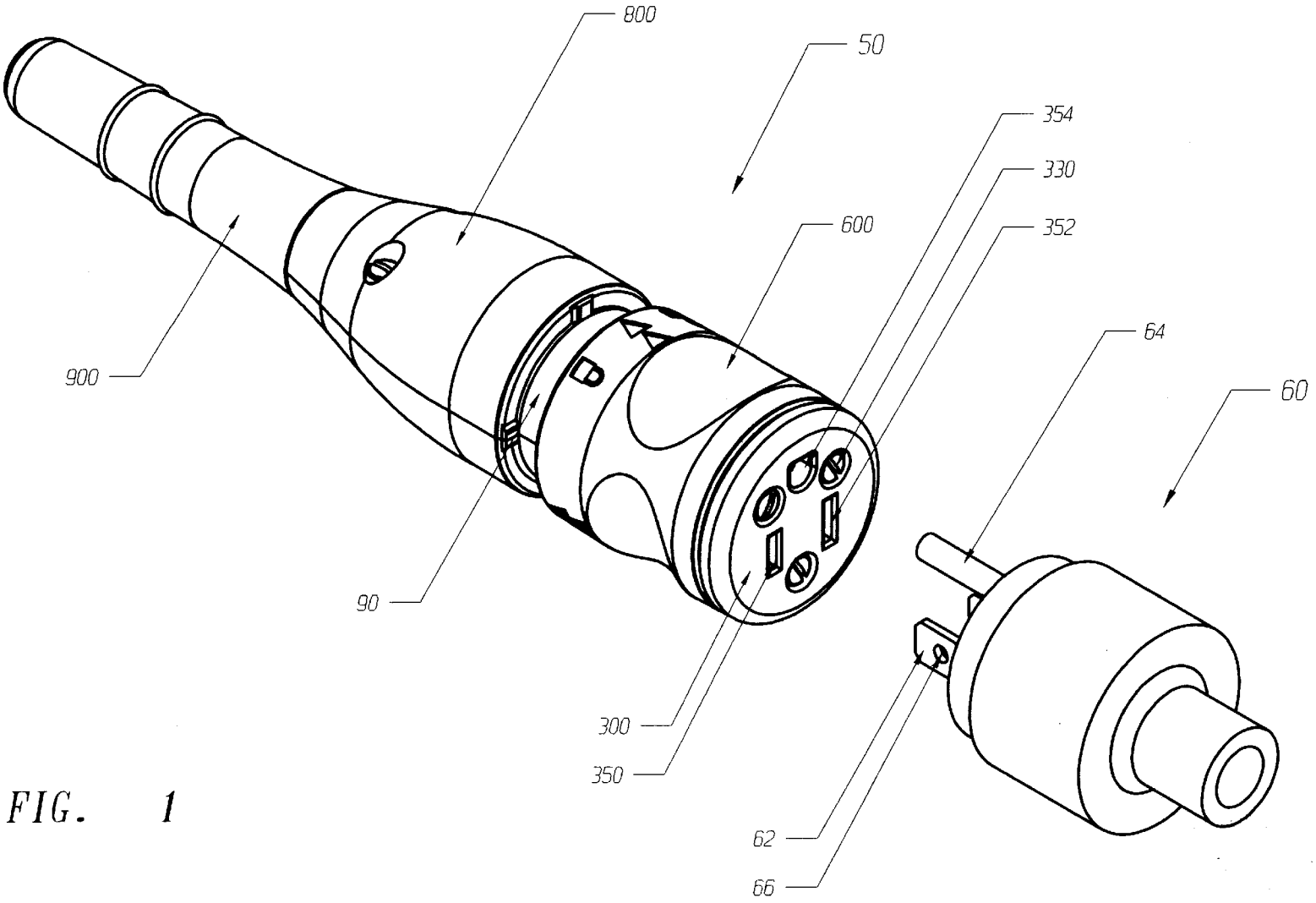
FIG. 1 is a perspective view of a version of the receptacle of the invention, with a view of a standard male electrical plug.

Referring in generally to the figures, an electrical receptacle 50 constructed in accordance with the principles of the invention is seen. The receptacle provides a body 90, formed from an upper body portion 100, a lower body portion 200 and a cap 300. A line contact assembly 400 and an identical neutral contact assembly are carried within the body, and make electrical contact with the line and neutral prongs of a standard two- or three-prong male electrical plug 60. A latching mechanism 700, carried by each contact assembly, engages the holes in the prongs of the plug, locking the plug to the receptacle. A ground contact assembly 500 is similarly carried within the body, and makes contact with the ground prong of the plug. A collar 600 is slidably carried about the body 90 between a forward position and a rearward position. In the forward position, the latching mechanism locks the plug in place. In the rearward position, the collar retracts the latching mechanism, thereby allowing the plug to be removed from the receptacle. A wiring cover 800 engages the body 90, and protects the terminals and wiring connections. A cord protector 900 extends from the wiring cover and provides extra support and protection for the electrical cord.

Figure 2:
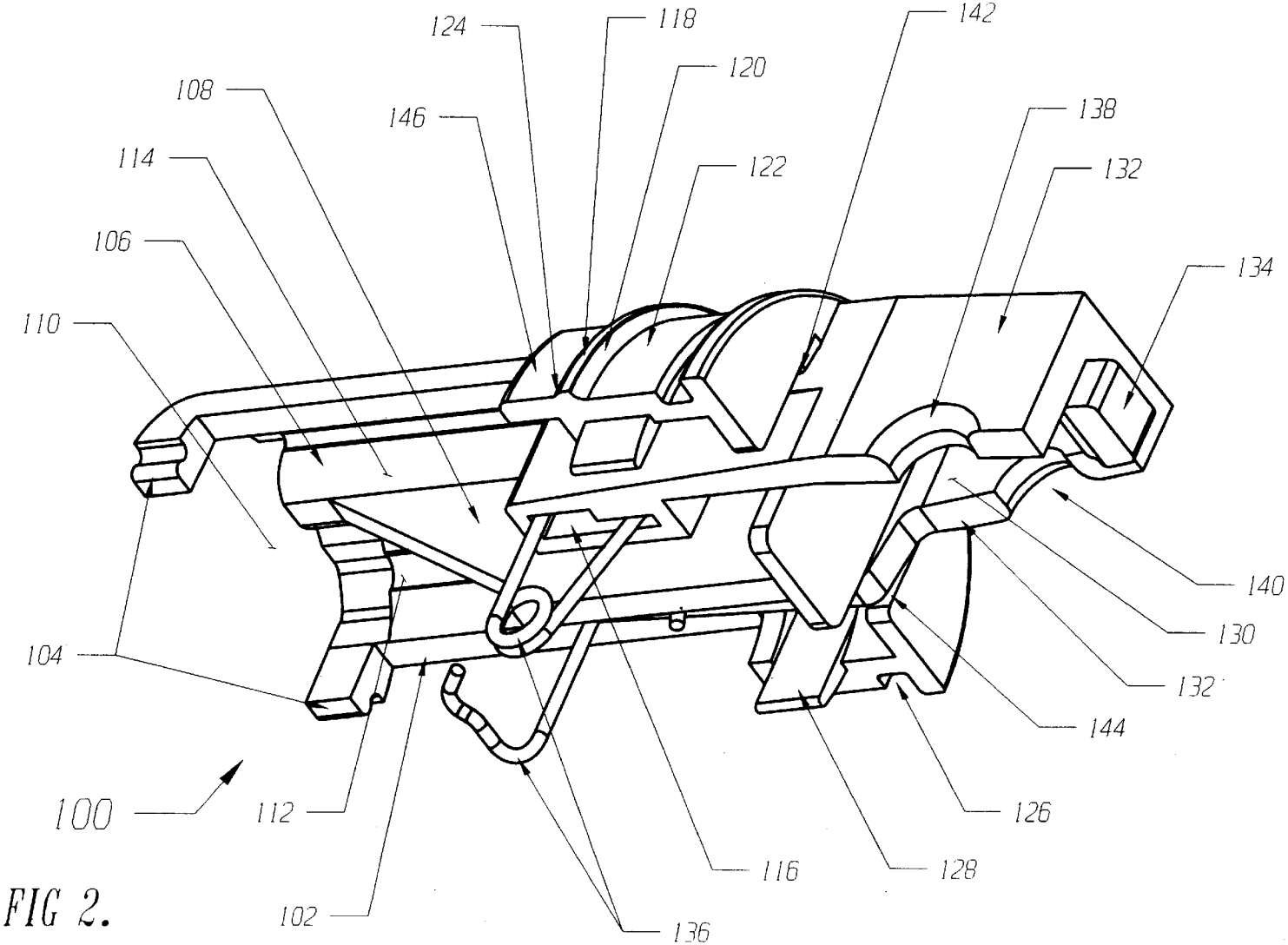
FIG. 2 is a perspective view of a version of the upper body portion of the invention.

A body 90 is formed from an upper body portion 100 and a bottom body portion 200. Both body portions are typically made from rigid plastic having electrically insulating properties. The top body portion, seen in FIG. 2, provides a generally half-cylindrical sidewall 102, which defines a forward cavity 110, a rear cavity 130, two spring wells 116, and a wiring cover interlock 126.

A line terminal screw recess 138, when combined with a line terminal screw recess 236 in the lower body portion, allows for clearance for the terminal screw carried by the line contact assembly. Similarly, a neutral terminal screw recess 140, when combined with a neutral terminal screw recess 238 in the lower body portion, allows for clearance for the terminal screw to the neutral contact assembly.

Figure 3:
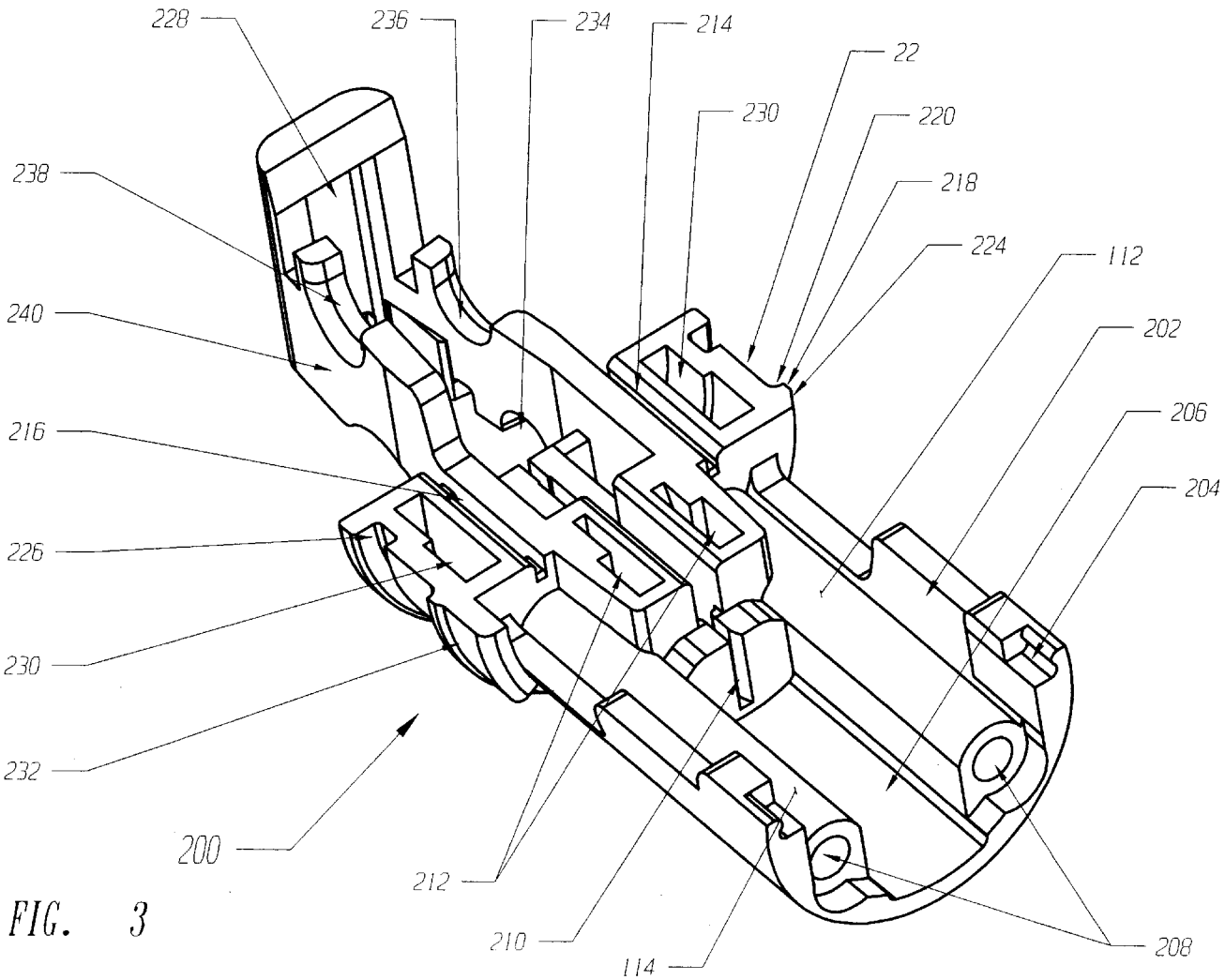
FIG. 3 is a perspective view of a version of the bottom body portion of the invention, specifically illustrating the inner structures of the upper body.

Similarly, as seen in FIG. 3, a ground terminal screw recess 234 allows for clearance for the ground terminal screw to be used to attach the ground wire 76 to the ground contact assembly 500.

Two forward snap pins 104 are sized to engage the snap pin sockets 204 of the lower body 200. A screw boss 106, carried by the sidewall 102 allows the cap 300 to be attached. A contact assembly isolator 108 is in the form of a wall extending radially inwardly from the sidewall which divides the forward cavity 110 into a left region 112 and a right region 114 in a manner that insures electrical isolation between the line and neutral assemblies.

Figure 5:
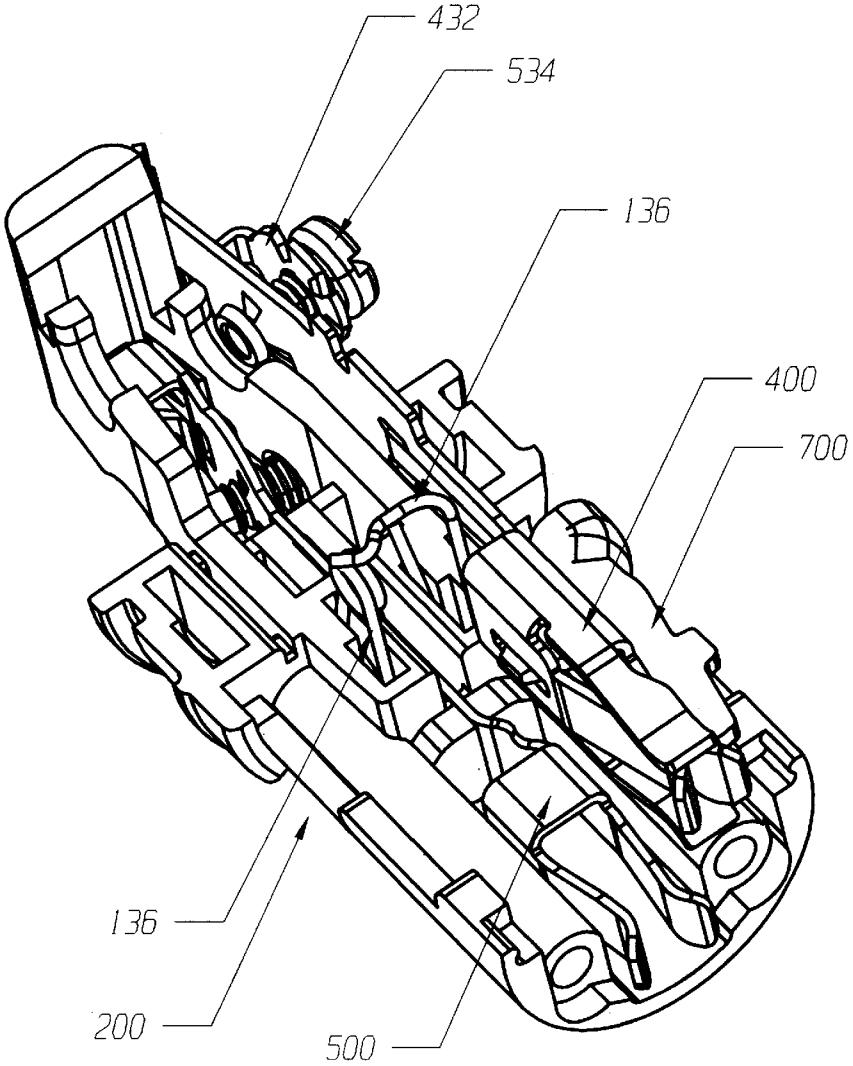
FIG. 5 is a view of the bottom body portion of FIG. 3, having the ground contact assembly, having one collar spring and the line contact latching mechanism installed.

The two spring wells 116 each carry a collar spring 136 as seen in FIGS. 2 and 5. The collar springs 136 extend through slots defined in the bottom body, and bias the collar 600 forwardly.

A collar guide 118 is defined in the outside portion of the sidewall 102, as seen in FIG. 2. The collar guide defines a dirt dam 120, a dirt recess 122 and a tapered rim 124. The dirt dam tends to prevent dirt from entering the receptacle 50, by providing a controlled fit between the body 90 and the collar 600. Dirt has a tendency to enter the receptacle because it is frequently dragged across the ground, the floor and other areas that are not clean. Generally, however, the controlled fit between the dirt dam 120 and the collar 600 minimizes dirt entry to the left and right cavities 112, 114 of the receptacle. In the event that small particles of dirt do enter, that dirt tends to collect in the left and right cavities. However, of the particles entering, a significant portion may be scraped by the dirt dam 120 from the textured inside surface 606 of the collar 600 as it is pulled rearwardly, and transferred to the dirt recess 122. Dirt accumulating in the dirt recess tends to be released as the collar is pulled rearwardly, making the unit self cleaning.

A wiring cover interlock 126 allows the upper body portion to be attached to the upper wiring cover 801. The wiring cover interlock 126 typically provides a recessed groove and a protruding rim that engage a similar interlock 810 in the upper wiring cover 801.

Two guide pins 128, extending outwardly from the body 100 are sized to engage guide pin sockets 230 in the lower body 200. The guide pins allow the upper body 100 to be properly aligned with the lower body in a positive manner.

A rear cavity 130 is defined in part by opposed terminal support surfaces 132 which support contact terminals 426 of the line and neutral contact assemblies. A rear anchor pin 134, at the back of the rear cavity, is sized to engage the rear anchor pin mount 228 of the bottom body.

Figure 4:
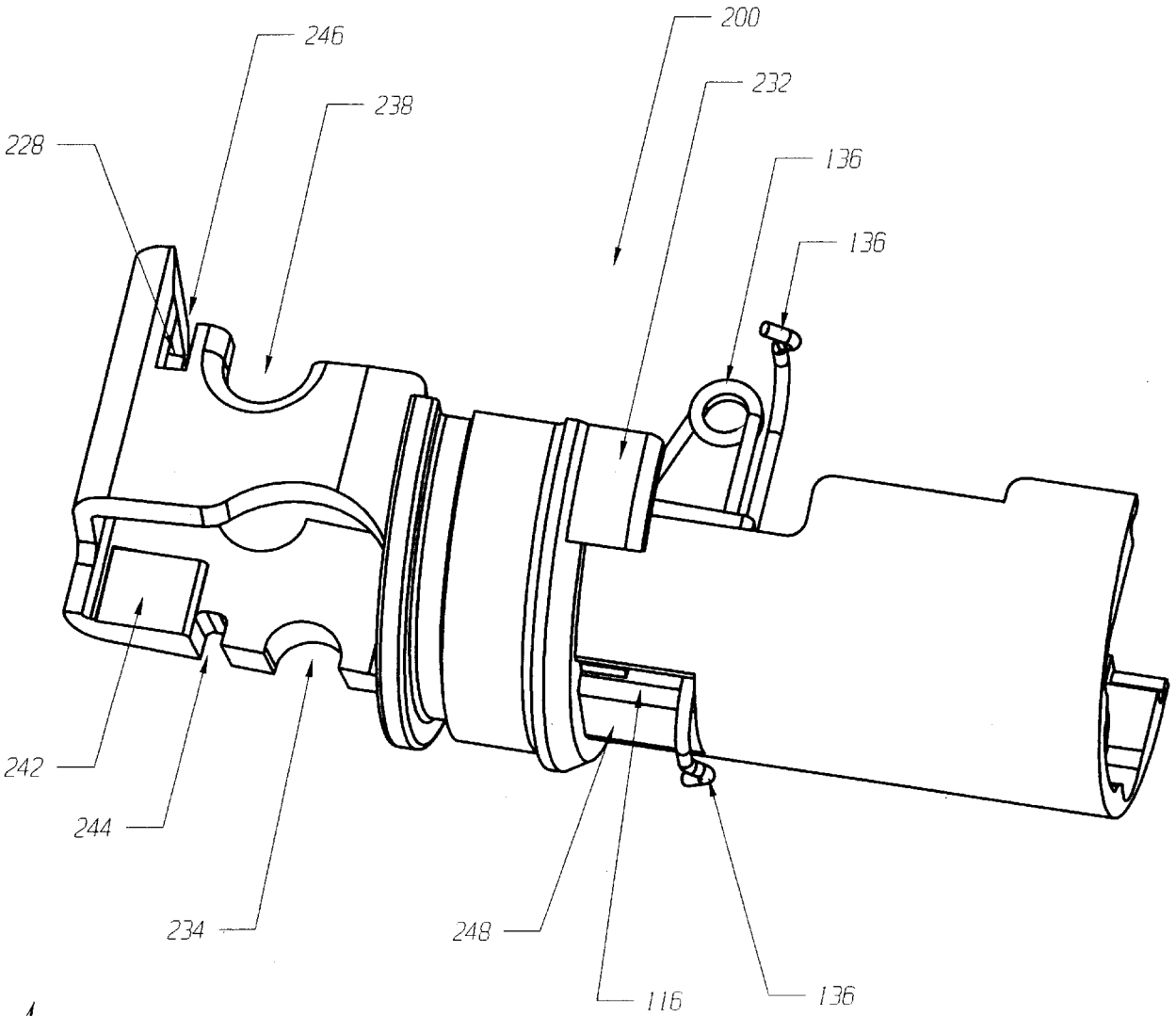
FIG. 4 is a perspective view of the underside of the bottom body portion of FIG. 3, and in particular the arrangement of the collar spring installation.

A lower body portion 200, seen in FIGS. 3–5, provides a generally half-cylindrical sidewall 202. The sidewall defines two forward snap pin sockets 204 which engage the forward snap pins 104 of the top body portion. The sidewall also defines two spring wells 212 which support springs which extend through slots in the sidewall 102 of the top body portion 100 and bias the collar 600 forwardly, identically to the upper body portion. A spring clearance recess 248 is provided to leave ample room in case debris, dirt or other foreign material should inadvertently be lodged in that area. The sidewall 202 also defines two guide pin sockets 230 which are sized to receive the guide pins 128 of the top body 100. A terminal support surface 240 provides a solid mounting platform for the metal components.

A collar rotation stop 146 is provided to prevent the collar 600 from rotating beyond its limits when it is pulled rearwardly, and rotated to either the left or right.

Also defined within the bottom body portion 200 are a line contact mounting slot 214, a neutral contact mounting slot 216, a ground contact mounting slot 210. These slots are sized to support the line contact assembly 400, an identical neutral contact assembly and the ground contact assembly 500, respectively. The slots 214 and 216 are particularly adapted to engage either the upper or lower contact mounting tabs 422, 424, and to thereby positionally anchor the contact assemblies. The ground contact mounting slot 210 is adapted to engage the alignment notch 510, to similarly anchor the ground contact assembly 500.

As is best seen in FIG. 3, the ground well 206 is a region within the bottom body adjacent to the left and right screw bosses 208 within which the ground contact assembly 500 resides.

A wiring cover interlock 226 is sized to engage the forward interlock 810 of the wiring cover.

Two screw bosses 208, carried by the sidewall 202, enable the bottom body portion to be fastened to the cap, typically with elongate screws 330.

A collar guide 218, defined by the sidewall, includes a dirt recess 222, a dirt dam 220, adjacent to the dirt recess, and a tapered rim 224. Collar guide 218 combines with the collar guide 118 of the top body 100, to form an annular collar guide about the body 90.

A rear anchor pin mount 228 is sized to engage the rear anchor pin 134 of the top body 100, and is best seen in FIGS. 3 and 4. Guide pin sockets 230 engage the guide pins 128 of the top body to align the top and bottom body portions when assembled together.

In the preferred embodiment of the invention, a cap 300 is attachable to the top and bottom body portions by means of screws 330 or other fasteners. The cap is best seen in FIGS. 6 and 7.

The cap provides a face 302 having a forward surface 304 and a rearward surface 306. The face defines a line prong hole 308, a neutral prong hole 310, a ground prong hole 312 and three fastening screw holes 314. One screw hole 314 is associated with, and aligned with, each screw boss 106, 208 provided by the upper or lower body portions, thereby allowing the cap to be attached to the upper and lower body portions.

The cap has a generally cylindrical body 316 defining a perimeter rim 318 having an annular shoulder 320. Three collar guides 326 extend rearwardly from the cylindrical body 316 to slide over the sidewalls 102, 202 of the top and bottom body portions, holding the cap in position prior to insertion of elongate screws through the holes 314 and into screw bosses 106, 208.

A ground isolator 322 is a precisely shaped elongate surface extending rearwardly from the rearward surface 306. The ground isolator provides electrical isolation between the ground contact assembly 500 and the line and neutral contact assemblies.

Similarly, a contact isolator 324, extending rearwardly from the face, when combined with the isolator 108 of the upper body portion 100 tends to physically separate and electrically isolate the line and neutral contact assemblies from each other.

A thinner section forming a dirt recess 319 of the perimeter rim 318 allows small dirt particles to enter and escape. When dirt does pass between the collar 600 and perimeter rim, the movement of the collar will tend to move the trapped dirt to the depression formed by the dirt recess 319. Dirt in this location will typically not effect the sliding motion of the collar 600, and is typically transferred to the inside of the receptacle.

A latch mechanism recess 332, seen in FIG. 7 provides the space required by the latching mechanism when the latch mechanism is in a released mode not engaged with the plug.

Figure 9:
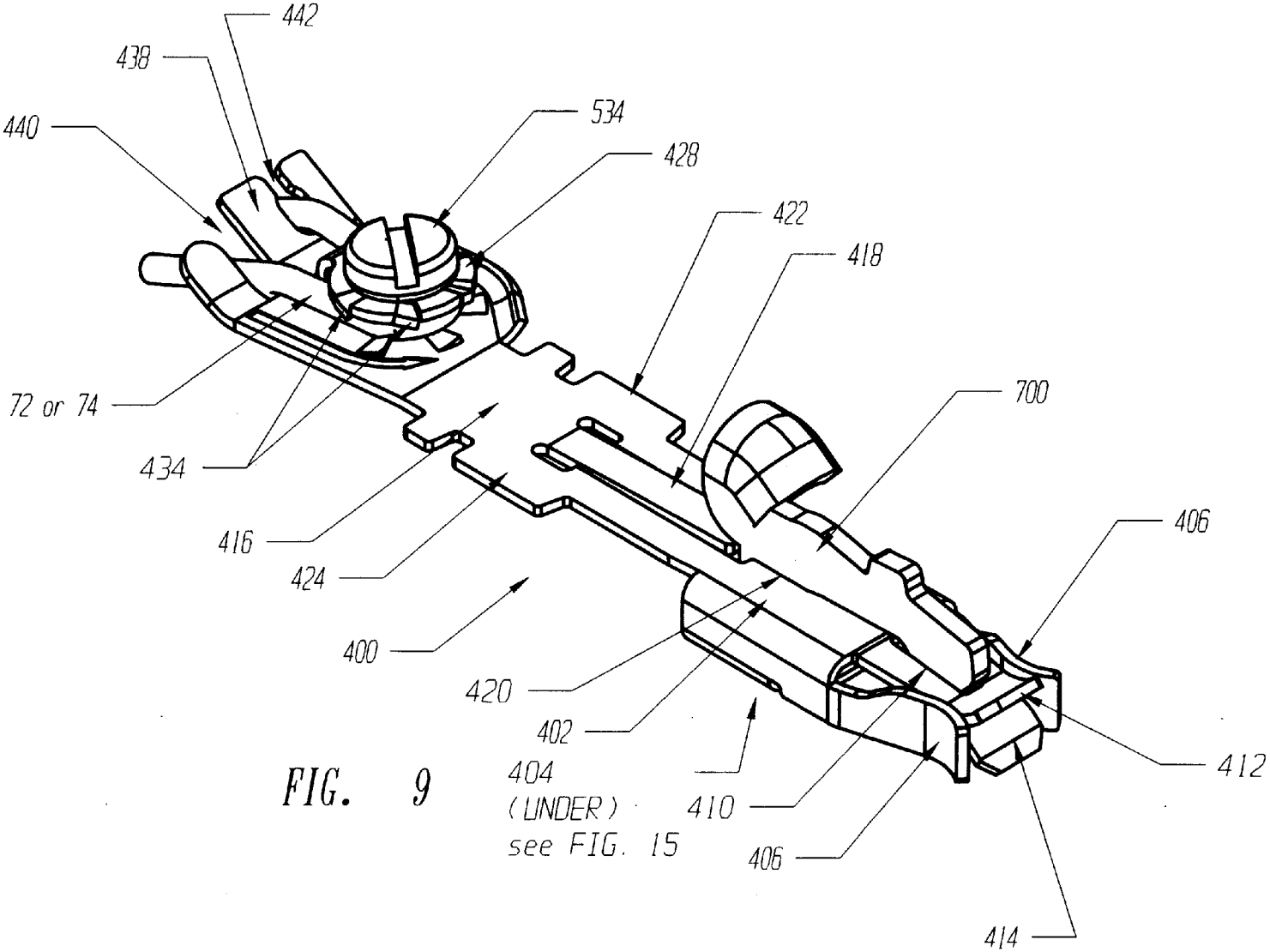
FIG. 9 is a perspective view of a version of the line or neutral contact assembly, the latching mechanism, the non-rotating wire clamp, the terminal screw and a typical 14 gauge wire that would normally be in place.
Figure 10:
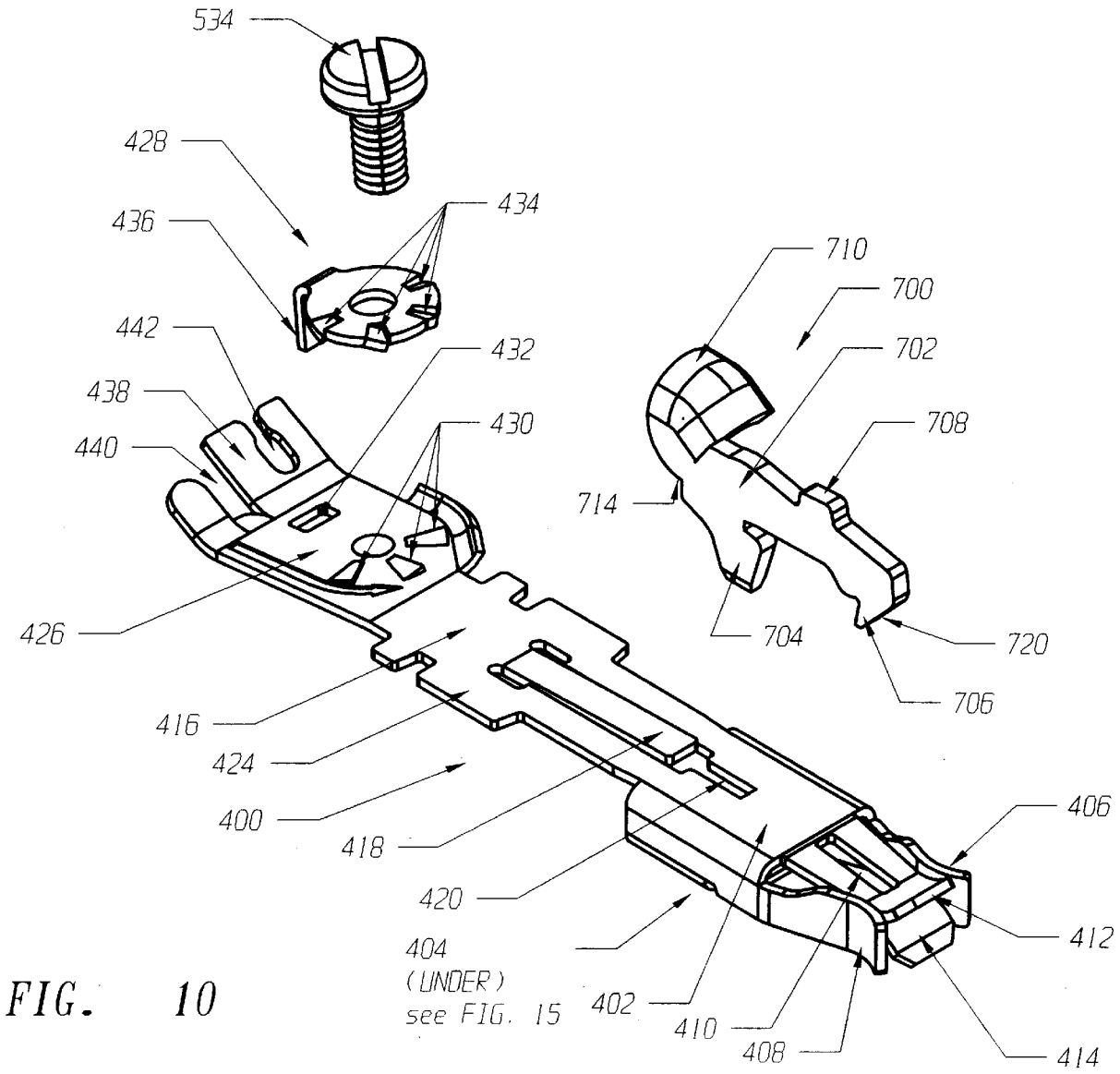
FIG. 10 is an exploded perspective view of the elements illustrated in FIG. 9, to better show their individual structures.

Referring to FIGS. 9 and 10, the line contact assembly 400 and an identical neutral contact assemblies are positioned 180 degrees from each other about a longitudinal axis. Auxiliary collar guide 334 provides additional support to the collar as well as adding strength to the shoulder 320 in that otherwise weaker area. The line contact assembly is associated with the "line" or "hot" prong 62 in a standard male electrical plug 60, while the neutral contact assembly is associated with the "neutral" or "return" prong in the plug 60.

The contact assemblies and latching mechanisms are formed from two different beryllium/copper alloys. This provides excellent current carrying capacity and also superior strength to other materials typically used in receptacle manufacture.

A prong enclosure 402, carries opposed left and right prong contacts 406, 408 and opposed upper and lower prong contacts 412, 414. Either the left or the right prong contact defines a slot 410 to allow for the latching mechanism barb 706 to enter. A structure including four prong contacts is advantageous because it allows physical and electrical contact to be made with all four sides of each prong of the male plug. Physical contact by the four prong contacts, particularly when the plug is inserted, tends to center the plug's prongs within the prong enclosure. The beryllium copper alloy provides a capacity to carry up to 5 times the normal current of typical phosphor bronze contacts, which is particularly useful on occasions where the current and load is suddenly abnormally high.

A planar body 416, extending rearwardly from the prong enclosure, defines a latching mechanism pivot slot 420 and a latching mechanism spring board 418. Upper and lower contact mounting tabs 422, 424, carried by the planar body, are appropriately sized to engage either the line or neutral mounting slots 214, 216 and the line or neutral mounting slots 142, 144 in the body portions 100, 200.

Figure 15:
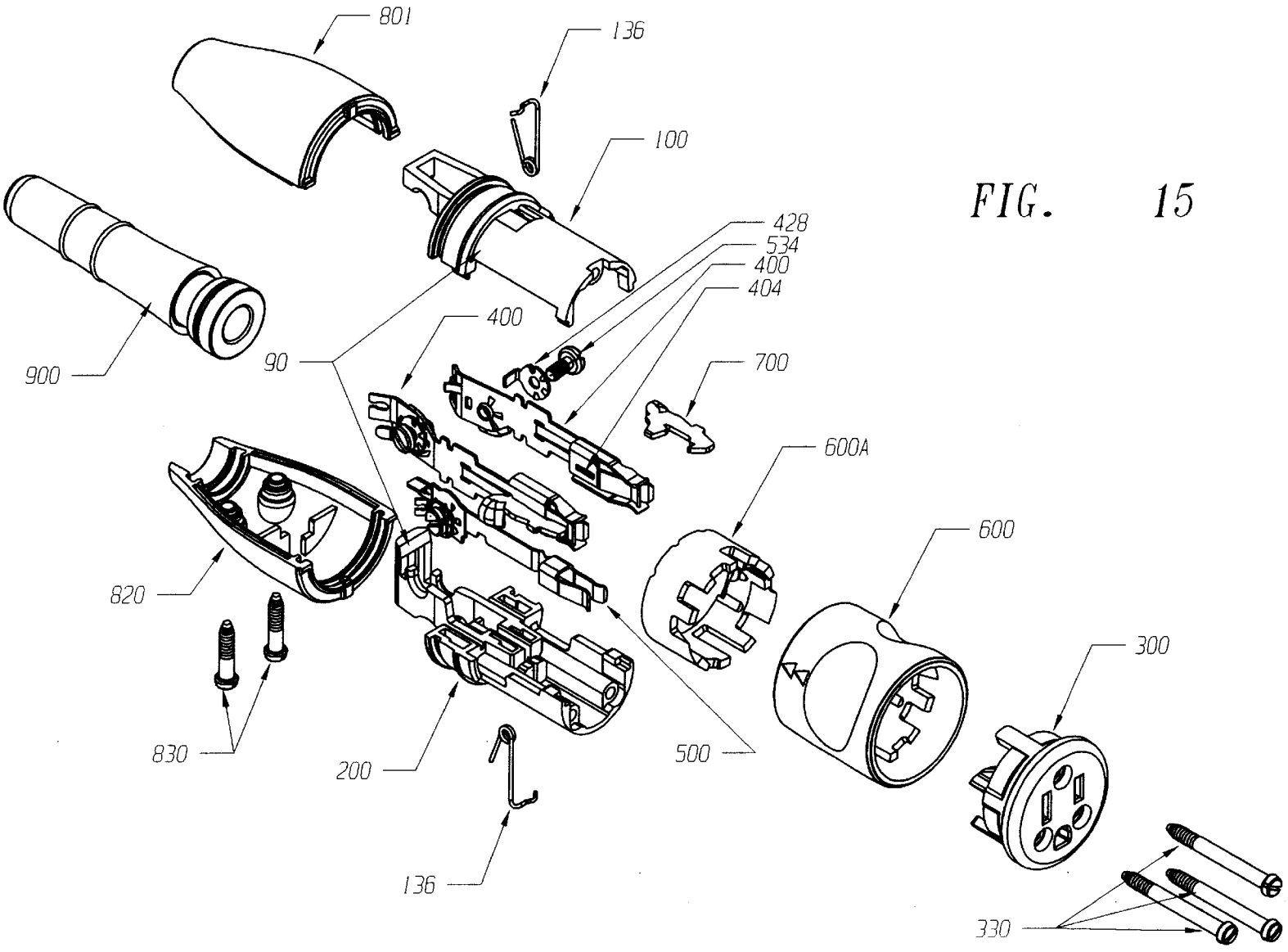
FIG. 15 is an exploded view of the receptacle.

The prong enclosure 402 also defines a latching mechanism alignment slot 404. (FIG. 15). The keel 704 of the latching mechanism is first inserted into the latching mechanism pivot slot 420, and then the lower portion of the keel is inserted into the alignment slot 404.

The latching mechanism spring board 418 is formed into the body 416 has a rib or slight depression formed into the spring board. The spring board biases the latching mechanism 700 into the locked position. It also acts as a retainer that holds the latching mechanism in place, and also prevents the latching mechanism from any rearward movement after installation.

A contact terminal 426 is carried by the planar body 416. The contact terminal defines three radially arrayed barbs 430 and a clamp slot 432. The contact terminal carries a non-rotating wire clamp 428 having a support arm 436, which is carried by the clamp slot 432. A screw 534 forces the clamp 432 against an electrical conductor wrapped about the screw, such as the line 72 or neutral 74 conductor of electrical cord 70, into contact with the contact terminal 426. The support arm 436 prevents the clamp from rotating as the screw is tightened. The non-rotating wire clamp defines four radially arrayed clamp barbs 434. As seen in FIG. 9, the contact terminal barbs 430 and the clamp barbs 434 are off-set, thereby tending to deform the line or neutral wire 72 or 74 into a somewhat sinusoidal configuration. The shape, size and angle of the clamp barbs, causes them to bite into the wire, preventing it from movement even during sudden and severe impact. Lack of rotation of the clamp keeps the four barbs 434 in the illustrated alternating alignment with the contact terminal barbs 430. This allows the clamp 432 to aggressively hold the wire in contact with the contact terminal 426, even where a dropped tool or other circumstance pulls with considerable force on the wire.

A wire guide slot 440 defined in the wire guide flange 438, holds the incoming wire 72 or 74 in place. The bare incoming wire passes through slot 440, then wraps about a screw or bolt holding the non-rotating wire clamp 432 against the contact terminal 426. The wire then wraps about the slot 442 where it may optionally be soldered in place and then terminates.

Two mirror image latching mechanisms 700, carried by the line and neutral contact assemblies, pivot between a locked position wherein the latching mechanism engages the hole in the prong of a standard electrical plug, and an unlocked position wherein the latching mechanism does not engage the plug.

Each latching mechanism 700 includes a body 702 defining a keel 704 sized to extend into the latching mechanism pivot slot 420 and through an opposed alignment slot 404 on another portion of the prong enclosure 402 of the line or neutral contract assembly. The latching mechanism spring board 418 bias the latching mechanism into the locked position and acts as the retainer that snaps in place on the latching mechanism once the latching mechanism has been properly installed during assembly. The spring board contacts the spring board seat 714 to prevent the latching mechanism from any rearward movement and from coming out of place after installation. A barb 706 is sized to extend into a hole in a prong of the standard male plug. The barb provides an angled front portion 720, as seen in FIG. 10, which causes the latching mechanism to pivot outward slightly, as a plug is inserted, before snapping into place about the hole in the prong.

Figure 12:
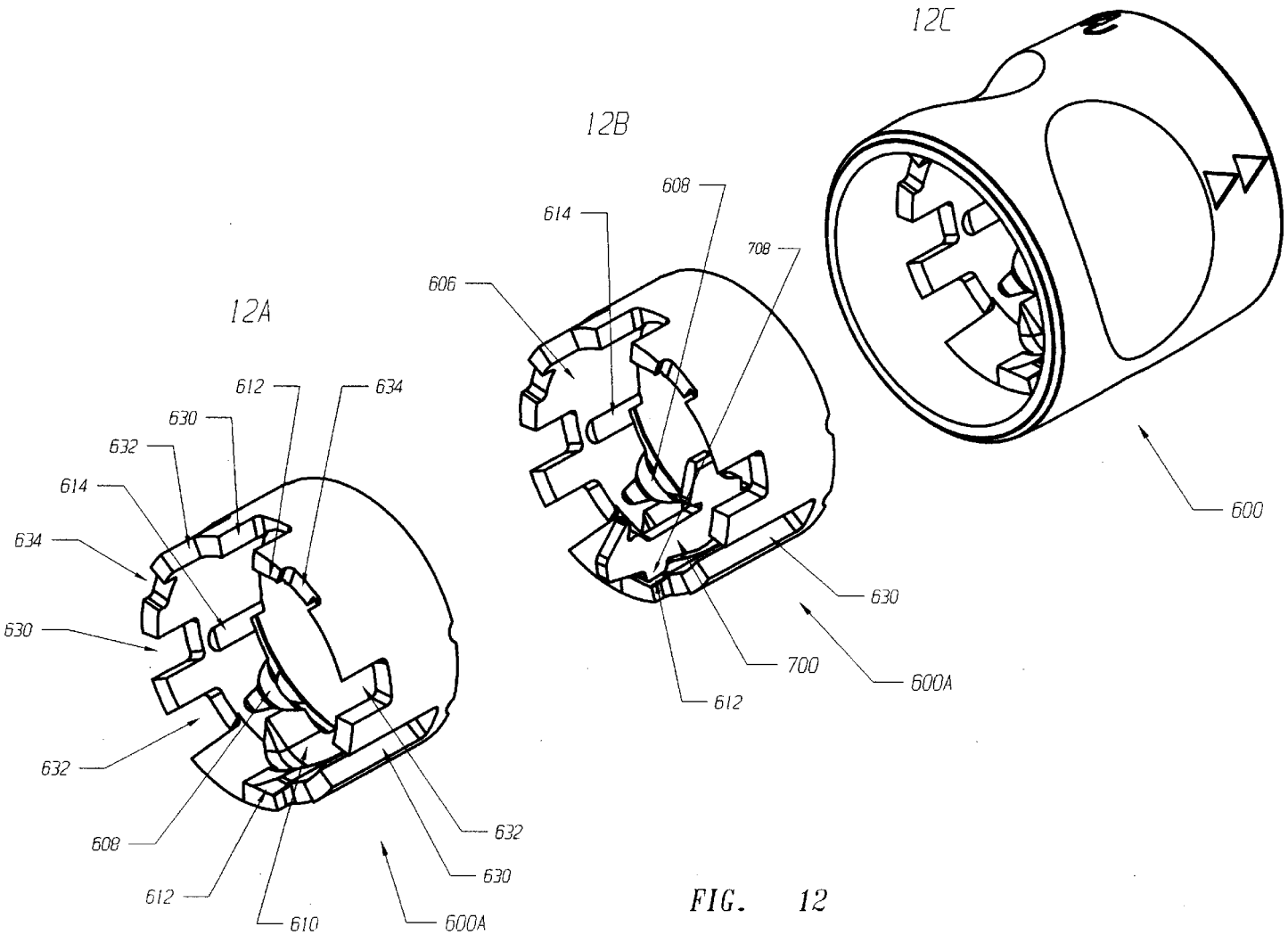
FIG. 12A is a perspective view from the front of a version of the inner portion of the collar.
FIG. 12B is a perspective view from the front of a inner portion of the collar seen in FIG. 12A, additionally illustrating how the inner portion of the collar interfaces with the latching mechanism.
FIG. 12C is a perspective view from the front of the one piece collar with inner and outer portions together as they are normally.

A safety lock tab 708 is sized to engage the safety lock seat socket 612 in the collar 600, as shown in FIG. 12B. When the safety lock tab engages the safety lock seat, due to the appropriate rotation and alignment of the collar, the latching mechanism is firmly held in place and may not be pivoted into the unlocked position under any circumstances. As a result, accidental or forced release of the plug is virtually impossible.

A release button 710 is sized to engage the release structure 608 in the collar 600, which moves the latching mechanism to the unlocked position when the collar is slid rearwardly against the bias of the spring.

Figure 8:
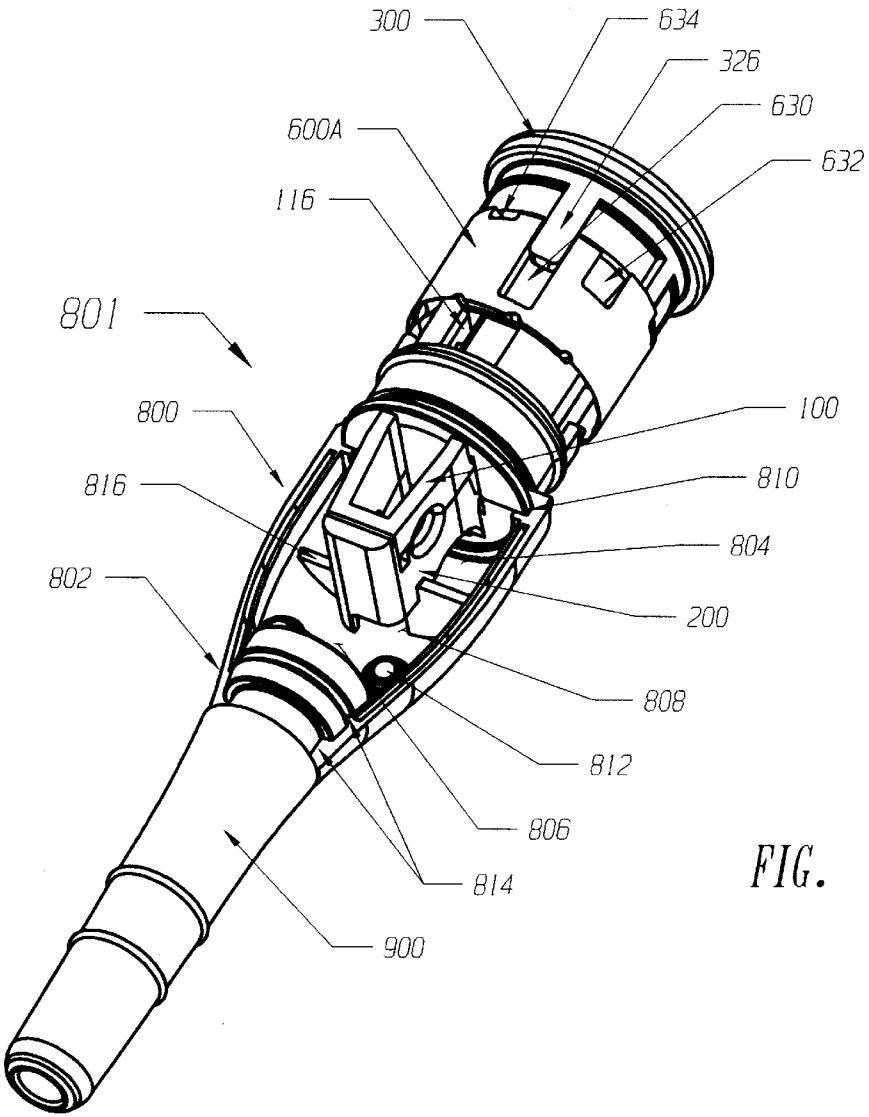
FIG. 8 is a perspective view of the cord protector attached to a wiring cover attached to both body portions attached to the cap carrying the collar, with the outer sleeve portion of the collar removed for clarity.
Figure 13:
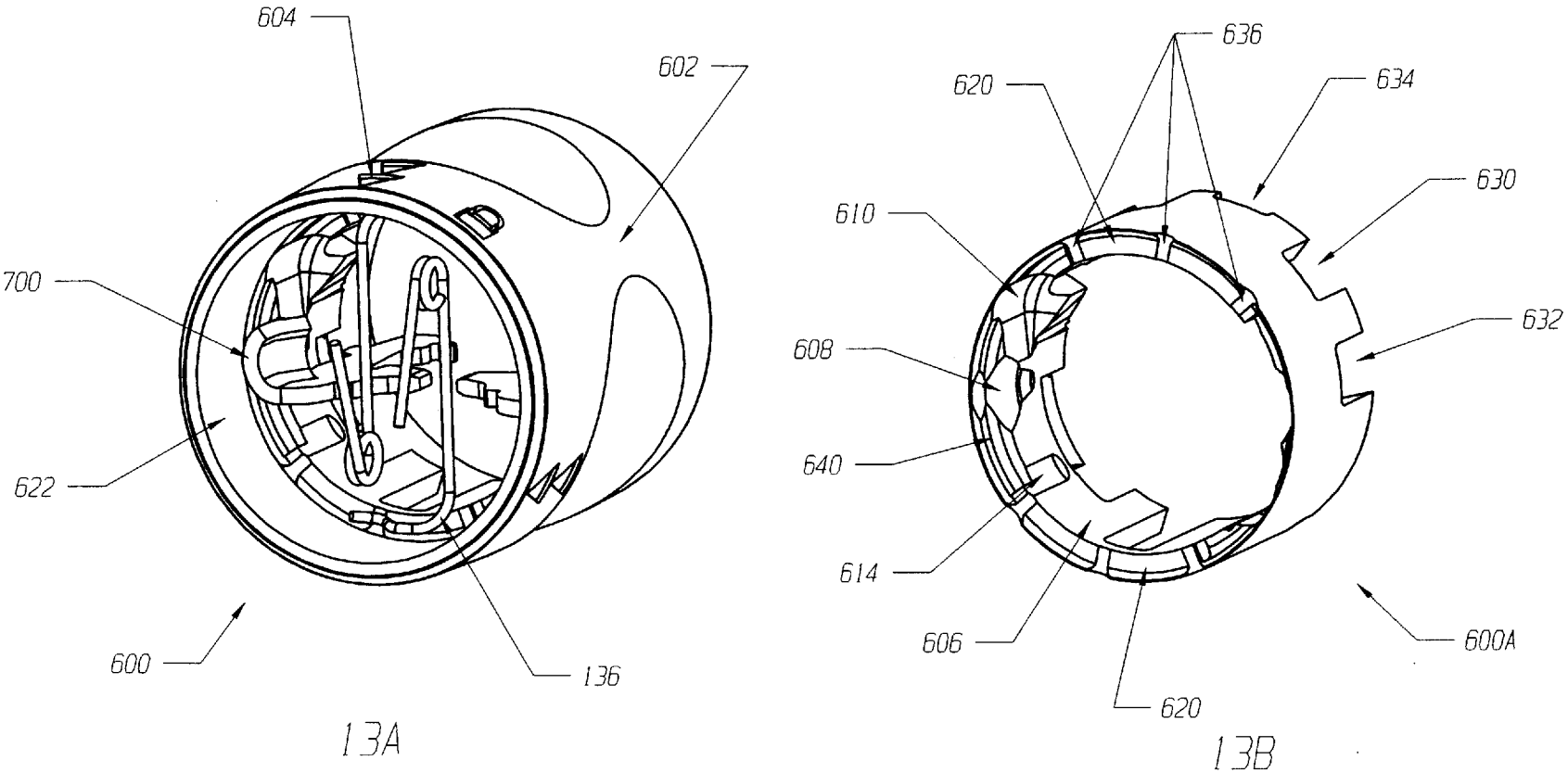
FIG. 13A is a perspective view from the rear of the one piece collar showing inner and outer portions of the collar of FIG. 12C, additionally showing the collar springs which bias the collar forwardly, and the mechanisms in place in standard mode.
FIG. 13B is a perspective view from the rear of the inner portion of the collar of FIG. 12A.
Figure 14:
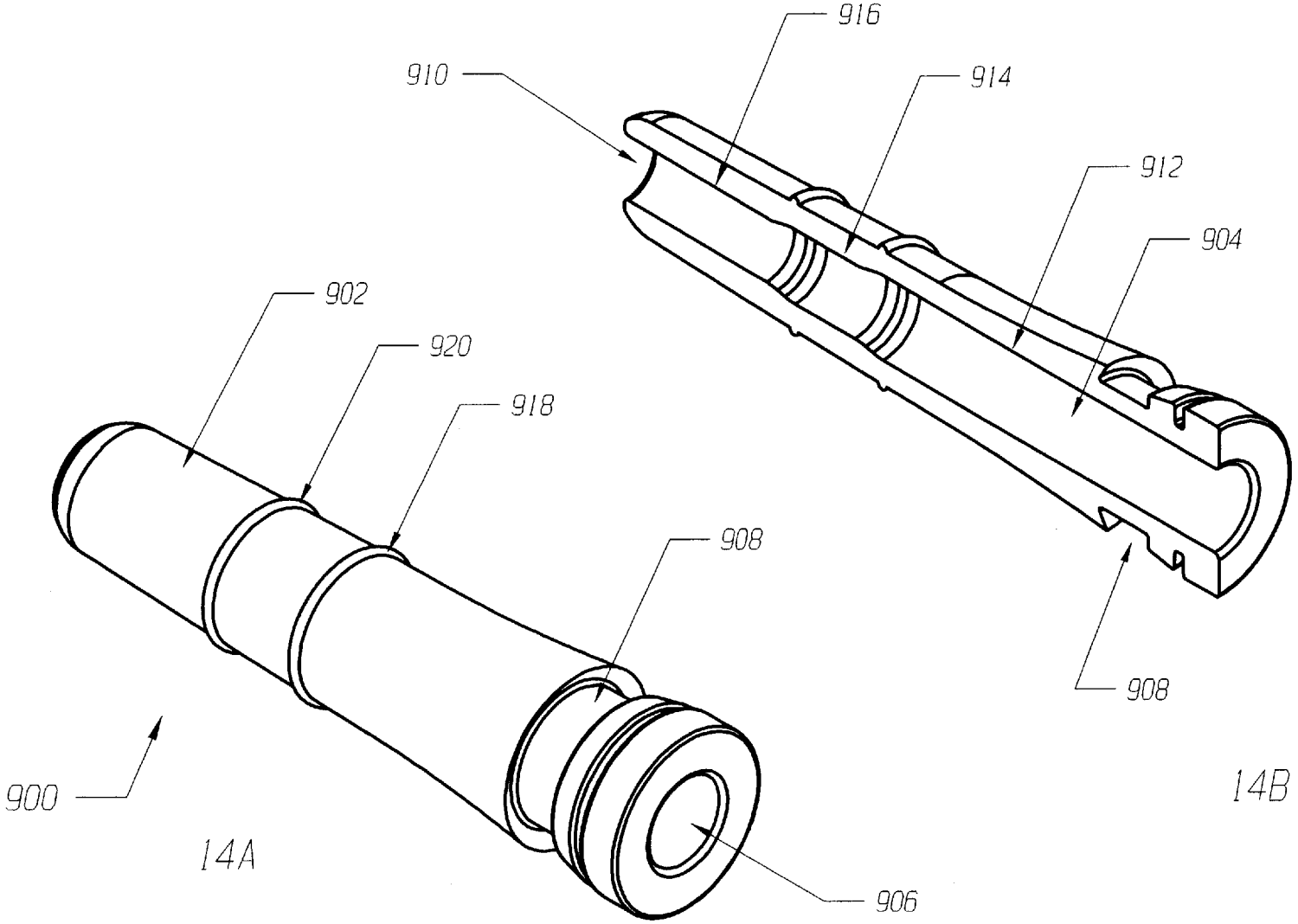
FIG. 14A is a perspective view from the front of the cord protector.
FIG. 14B is a cross-sectional view of the cord protector of FIG. 14A.

A collar 600 is carried about the body 90, and is manually slidable between a forward position and a rearward position. Springs 136 carried by the spring wells 116, 212 tend to bias the collar forwardly, as shown in FIGS. 8 and 13A. The collar has a generally cylindrical body having an outside surface 602 with informative icons 604, such as the arrows seen in FIG. 12, or other inscriptions.

The inside surface 606 of the collar defines two release structures 608, which are associated with the automatic of operation. In this mode of operation, when the collar is slid rearwardly, against the bias of the springs, the release structures depress both release buttons 710 of both latching mechanisms 700, thereby retracting the barbs 706 from the holes in the prongs of the electrical plug. Consequently, the plug may be withdrawn manually by the operator. In the automatic mode of operation, the collar will move completely forwardly and rearwardly under the bias of the springs slots 630.

The inside surface 606 of the collar also defines two diametrically opposed release disable structures 610 seen in FIG. 12A, and two diametrically opposed safety lock seats 612, all of which are associated with a release disable mode (positive lock mode) of operation. In this mode of operation, the plug may not be removed under any circumstance. This mode of operation is engaged by sliding the collar rearwardly, and then rotating the top or forward end of the collar completely to the left until it is stopped by the collar rotation stop 232 and 146 which is now within the two rotation stop keyways 640. The collar then springs forwardly under the bias of the springs 136 with the collar guides 326 aligning themselves into the guide seats 632. This also prevents any rotational movement of the collars until the collar is again pulled completely rearwardly. This causes the release disable structures 610 to engage the release button 710 of the two latching mechanisms 700 in a manner that prevents movement, and also causes the safety lock seats 612 to engage the safety lock tabs 708 of the two latching mechanisms. This prevents the barbs 706 of the latching mechanisms from accidentally or otherwise being retracted from the holes in the prongs of the plug 60. In this second mode of operation, it is virtually impossible to remove the plug, as the prongs of the plug are engaged by the latching mechanism.

The inside surface 606 of the collar also defines two diametrically opposed release hold structures 614, which are associated with a release hold mode of operation. In this mode of operation, the plug may be removed from the socket without rotation or sliding motion of the collar, much in the manner that is common to the operation of most receptacles. This mode of operation is engaged by sliding the collar completely rearwardly, and then rotating the top or forward end of the collar to the right until it is stopped by the collar rotation stop 232, 146 which is now within the two rotation stop keyways 640. The collar will move partially forwardly under the bias of the springs 136 with the collar guides 326 to align themselves into the guide slots 634. This also prevents any rotational movement of the collar until the collar is again pulled completely rearwardly. This causes the release hold structures 612 to engage the release button 710 of the latching mechanisms 700. This prevents the barbs 706 of the latching mechanisms 700 from being inserted into the holes in the prongs of the plug 60. As a result, in this mode of operation the receptacle acts as a normal receptacle without locking the plug in place. To again rotate the collar back to the automatic mode, it must again be pulled back, against the bias of the springs.

The inside surface 606 of the collar also defines a spring engagement rim 620 further defining three pair of spring stops 622. Each pair of spring stops 622 are associated with one of (the above) three modes of operation. Each mode of operation is in turn associated with the degree to which the collar is rotated. As the collar is rotated, the springs 136 that are carried by the spring wells 116, 212 slide along the rim 620 and then snap into place on one of the pairs of spring stops.

The nature and thickness of the springs may be varied, as desired, to achieve the desired bias on the collar. In general, the bias should be strong enough that the collar does not move without intentional effort, but weak enough that undue effort is not required to move the collar.

Figure 11:
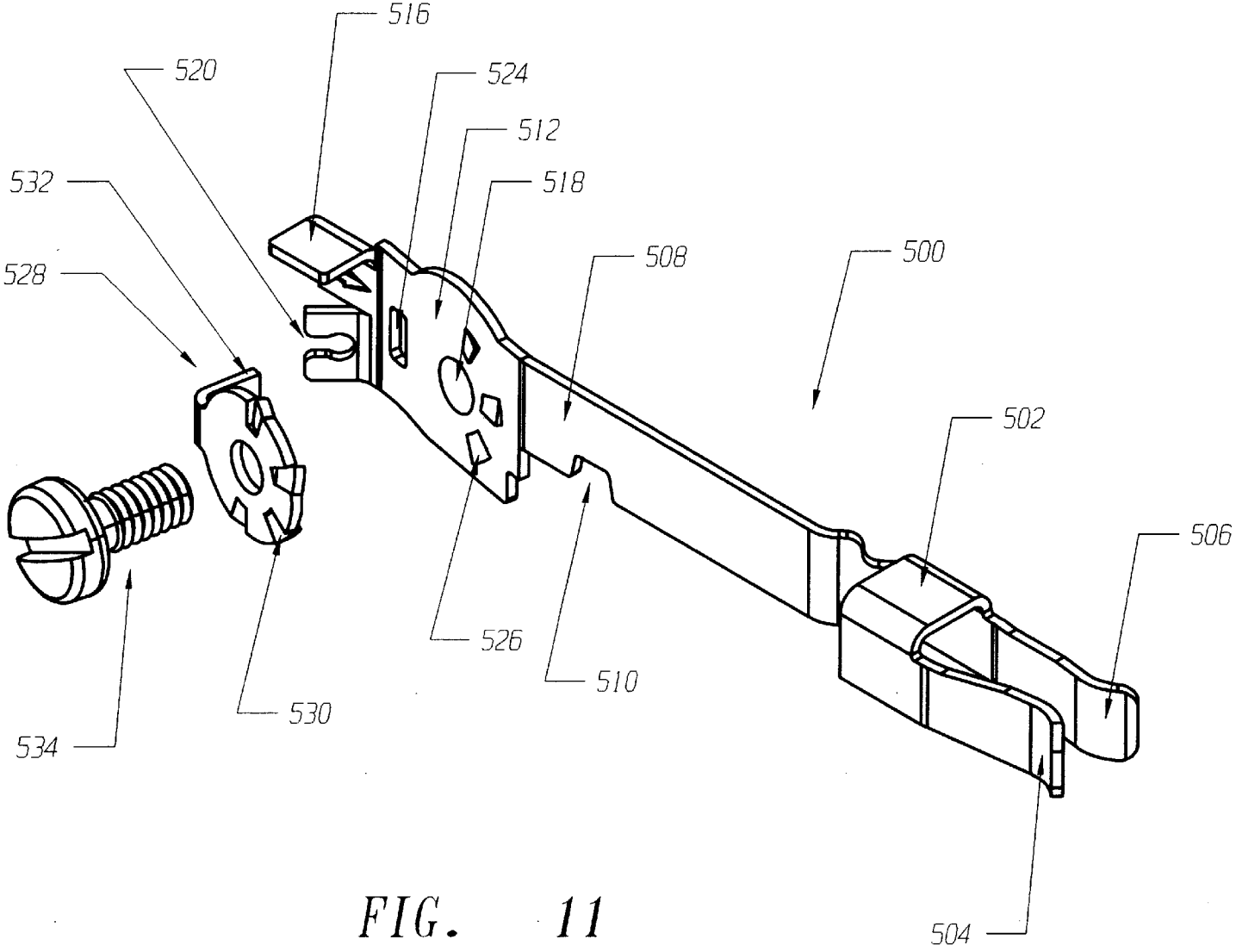
FIG. 11 is a perspective view the ground contact assembly in an exploded form.

Referring to FIG. 11, a ground contact assembly 500 makes electrical contact with the ground prong in the standard male electrical plug. The ground contact assembly provides a contact support 502 carrying left and right contacts 504, 506 which are sized for making electrical contact with a ground prong of the standard male plug. An elongate body 508, connected to the contact support 502, defines an alignment notch 510 sized for insertion into the ground contact mounting slot 210 in the lower body portion 200. A contact terminal plate 512 is part of and integral to the elongate body 508. The contact terminal plate carries an upper curved flange 516 which acts as a ground wire guide to the terminal screw area. The contact terminal plate defines a threaded fastening hole 518 and may include one or more barbs 526 and a clamp slot 524. The clamp slot engages the support arm 532 of a non-rotating wire clamp 528 having a plurality of clamp barbs 530. An in-coming ground wire 76 is fastenable to the contact terminal plate 512 by the non-rotating wire clamp 528 driven by a terminal screw 534. The wire then wraps about the soldering structure 520, where it may be optionally soldered in place, and where it terminates.

As seen in FIG. 8, a wiring cover is formed from an upper wiring cover section 801 and a lower wiring cover section 800. The upper and lower wiring covers are similarly constructed and may be connected together by fastening means such as screws and screw bosses 812. Each wiring cover section provides a tapered body 802 defining an interior cavity 808 having an open forward end 804 and an open rearward end 806. A forward interlock 810, defined in the forward end of the tapered body, is sized to engage the wiring cover interlocks 126, 226 of the top body portion and bottom body portion. A rearward interlock 818, defined in the rearward end of the tapered body, allows the wiring covers to be connected to the cord protector 900. The rib-like supporting structures 816, which are integral with the wiring covers are located to fit tightly on and around the terminal support structures 240 and 132. This tends to give the wiring covers structural rigidity, preventing crushing or deformation of the covers when loads are placed on the covers from any direction.

A cord protector 900 provides an elongate tapered body 902 defining an interior cavity 904 having a forward opening 906 and a rearward opening 910. The elongate body includes a forward interlock 908 sized to engage the rearward interlock 814 of the top and bottom wiring covers.

The interior of the cord protector is stepped in various diameters 912, 914, 916 to accommodate different cord diameters. On the outside of the protector 900 are two small annular ribs 918, 920. These ribs indicate where the internal diameters change in thickness. By shortening the protector by cutting through the protector just rearward of the ribs, the new diameters are exposed thereby allowing the required cord diameter to fit properly.

To use the electrical receptacle of the invention, a standard electrical plug is simply inserted into the receptacle. A very noticeable clicking sound indicates that the latching mechanism 700 has automatically engaged the holes in the prongs of the electrical plug. To release the plug, the collar is slid rearwardly, against the bias of the springs. The release structure 608 engages the release button 710 of the latching mechanism, causing it to pivot against the bias of spring board 416, thereby releasing the plug. The collar is then allowed to snap back in the forward direction.

Where it is desirable to have the plug more securely locked into the receptacle in such a way as to prevent accidental release, even with unintended collar movement, the collar is pulled completely rearwardly and rotated to the left until it stops. The collar will then spring forward automatically. This causes the release disable structure 610 to engage the release button 710 of the latching mechanism 700 and the safety lock seat 612 of the collar to engage the safety lock tab 708 of the locking mechanism 700. To release the plug, the collar is slid rearwardly and then rotated to the right, and the plug is removed. The collar then snaps forward, under the bias of the springs.

Where it is desirable to more easily release the plug from the receptacle, the collar is pulled rearwardly against the springs, rotated to the right, and allowed to spring forwardly. This causes the release hold structure 612 of the collar 600 to engage and hold the release button 710 of the latching mechanism 700, preventing the latching mechanism from engaging the plug. The plug may be inserted or removed manually, at any time, in the normal manner, without further use of the collar. To return to the normal automatic locking mode, the collar is pulled rearwardly and then rotated to the left. The collar then snaps forward, under the bias of the springs.

Although the present invention has been described in considerable detail and with reference to certain preferred versions, other versions are possible. For example, the direction of collar rotation, to engage the release disable and release hold structures is purely arbitrary, and could be reversed. Similarly, the release hold and the release disable modes can be eliminated and the receptacle operated in automatic mode only. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An electrical receptacle, suitable for use with a standard male electrical plug, the elctrical receptacle comprising:

(A) a body, formed from an upper body portion fastened to a lower body portion;

(B) a cap, carried by the body;

(C) a line contact assembly and a neutral contact assembly, both assemblies carried within the body, each assembly comprising:

(a) at least two prong contacts;

(b) a planar body in electrical communication with the at least two prong contacts, the planar body defining a latching mechanism pivot slot; and (c) a latching mechanism having a barb sized to engage a prong of the standard male plug, the latching mechanism pivotably carried by the latching mechanism pivot slot;

(D) a collar, slidably carried over the body, between a forward position and a rearward position, the collar also rotatable about the body, the collar comprising a hollow cylindrical body having an inside surface defining release means for engaging a release button of the latching mechanism when the collar is in the rearward position, thereby causing the barb of the latching mechanism to release a prong of the standard male plug; and (E) biasing means, carried by the body and the collar, for biasing the collar to the forward position.

2. The electrical receptacle of claim 1, wherein the collar additionally comprises release hold means, carried by the collar, and engaged by rotation of the collar, for preventing the barb of the latching mechanism from engaging the prong of the standard plug.

3. The electrical receptacle of claim 1, wherein the collar additionally comprises release disable means, carried by the collar, and engaged by rotation of the collar, for preventing the barb from releasing the prong of the standard male plug when the collar is slid from the forward position to the rearward position.

4. An electrical receptacle, suitable for use with a standard male electrical plug, comprising:

(A) an upper body portion, comprising:

(a) a sidewall, defining a forward cavity, a rear cavity, at least one spring well, and a wiring cover interlock;

(b) at least one forward snap pin, carried by the sidewall;

(c) at least one screw boss, carried by the sidewall;

(d) a contact isolator, carried by the sidewall;

(e) a collar guide, defined by the sidewall, comprising:

(i) a dirt recess;

(ii) a dirt dam, adjacent to the dirt recess; and (iii) a tapered rim, adjacent to the dirt dam;

(f) at least one guide pin, carried by the collar guide;

(g) a terminal support surface, carried by the sidewall;

(h) a rear anchor pin, carried by the sidewall; and (i) a spring, carried in each of the at least one spring well;

(B) a lower body portion, attachable to the top body portion, comprising:

(a) a sidewall, defining at least one forward snap pin socket, at least one spring well, a line contact mounting slot, a neutral contact mounting slot, a ground contact mounting slot, a ground well, at least one guide pin socket sized to engage the at least one guide pin carried by the top body portion, and a wiring cover interlock;

(b) at least one screw boss, carried by the sidewall;

(c) a collar guide, defined by the sidewall, comprising:

(i) a dirt recess;

(ii) a dirt dam, adjacent to the dirt recess; and (iii) a tapered rim, adjacent to the dirt dam;

(d) a rear anchor pin mount, sized to releasably engage the rear anchor pin;

(C) a cap, attachable to the top and bottom body portions, comprising:

(a) a face defining a line prong hole, a neutral prong hole, a ground prong hole and at least two fastening screw holes;

(b) a cylindrical body defining a perimeter rim having an annular shoulder;

(c) a ground isolator, extending rearwardly from the face;

(d) a contact isolator, extending rearwardly from the face; and (e) at least two collar guides, carried by the cylindrical body;

(D) a line contact assembly and a neutral contact assembly, carried between the top and bottom body portions, each assembly comprising:

(a) a prong enclosure, carrying opposed left and right prong contacts and carrying opposed upper and lower prong contacts;

(b) a planar body, extending from the prong enclosure, defining a latching mechanism pivot slot, a latching mechanism alignment slot and a latching mechanism spring board;

(c) upper and lower contact mounting tabs, carried by the planar body;

(d) a contact terminal, carried by the planar body, defining at least one barb and a clamp slot;

(e) a non-rotating wire clamp having a support arm carried by the clamp slot, the non-rotating wire clamp defining at least one barb;

(f) a wire guide flange, carried by the planar body, defining a wire guide slot and a soldering hole; and (g) a latching mechanism, comprising a body defining a keel sized to extend into the latching mechanism pivot slot, a barb sized to extend into a hole in a prong of the standard male plug, a safety locking tab and a release button;

(E) a ground contact assembly, carried by the bottom body portion, comprising:

(a) a contact support, carrying left and right contacts sized for making electrical contact with a ground prong of the standard male plug;

(b) an elongate body, connected to the contact support, having an alignment notch;

(c) a contact terminal plate defining a threaded fastening hole and a clamp slot, the contact terminal plate connected to the elongate body; and (d) a non-rotating wire clamp having at least one barb, the non-rotating wire clamp having a support arm carried by the clamp slot;

(F) a collar, slidably carried about the upper and lower body portions, between a forward position and a rearward position, the collar comprising a cylindrical body defining:

(a) release means for engaging the release button of the latching mechanism when the collar is in the rearward position;

(b) release disable means for preventing the barb of the latching mechanism from releasing the prong of the standard male plug; and (c) release hold means for preventing the barb of the latching mechanism engaging the prong of the standard male plug;

(G) a top wiring cover and a bottom wiring cover, carried by the top and bottom body portions, each wiring cover comprising:

(a) a tapered body defining an interior cavity having open forward and rearward ends;

(b) a forward interlock, defined in the forward end of the tapered body, sized to engage the wiring cover interlock of the top body portion and bottom body portion; and (c) a rearward interlock, defined in the rearward end of the tapered body; and (H) a cord protector, carried by the top and bottom wiring covers, comprising an elongate body defining an interior cavity, the elongate body having a forward opening framed by a forward interlock sized to engage the rearward interlock of the top and bottom wiring covers.

5. An electrical receptacle, suitable for use with a standard male electrical plug, the electrical receptacle comprising:

(A) a body, formed from an upper body portion fastened to a lower body portion;

(B) a cap, carried by the body;

(C) a line contact assembly and a neutral contact assembly, both assemblies carried within the body;

(D) a latching mechanism pivotably carried by the line contact assembly;

(E) a collar, slidably carried over the body, between a forward position and a rearward position, and the collar rotatable about the body, the collar comprising a cylindrical body defining means for engaging a release button of the latching mechanism when the collar is in the rearward position, thereby causing a barb of the latching mechanism to release a prong of the standard male plug;

(F) biasing means, carried by the body and the collar, for biasing the collar to the forward position;

(G) release hold means, carried by the collar, for preventing a barb of the latching mechanism from engaging the prong of the standard plug; and (H) release disable means, carried by the collar, and engaged by rotation of the collar, for preventing the barb from releasing the prong of the standard male plug when the collar is slid from the forward position to the rearward position.

* * * * *